United States Patent [19]

Geringer et al.

[11] Patent Number: 4,609,910

[45] Date of Patent: Sep. 2, 1986

[54] EXIT DOOR SECURITY SYSTEM

[76] Inventors: Arthur V. Geringer, 4611 Deseret, Woodland Hills, Calif. 91364; Richard G. Geringer, 28834 Barragan St.; David A. Geringer, 5382 Cheseboro Rd., both of Agoura, Calif. 90301

[21] Appl. No.: 721,635

[22] Filed: Apr. 9, 1985

[51] Int. Cl.[4] ..... G08B 13/08

[52] U.S. Cl. ..... 340/545; 340/541; 49/31; 70/92; 70/93; 292/DIG. 19; 200/61.62

[58] Field of Search ..... 340/545, 547, 542, 540, 340/541; 361/160, 170; 292/DIG. 65, 68, DIG. 19; 200/61.62, 61.64, 61.81, 61.82; 70/91-93, 267; 49/29-31, 26

[56] References Cited

U.S. PATENT DOCUMENTS 4,123,752 10/1978 Novotny ..... 340/545

4,284,980 8/1981 Hoinski ..... 340/545

*Primary Examiner*—Donnie L. Crosland

*Attorney, Agent, or Firm*—John J. Posta, Jr.

[57] ABSTRACT

The system automatically warns when opening of an exit door is attempted, causing an alarm to be made and preventing full opening for a predetermined period of time. Such a system includes an electromagnet, timer, alarm and activator switch connected in series with a power source such as house current and disposed in and around the frame with no electrical connection to or from the door. A magnetically attractable plate or prong is secured to the door adjacent to the electromagnet. The switch may include a spring biased plunger on the frame, held in the closed circuit position against the spring bias with the door closed. The switch automatically moves to the closed circuit position when the door begins to open, causing an alarm to be immediately sounded and the plate to continue to be strongly held by the electromagnet, thereby preventing full opening of the door. The system permits the full opening of the exit door only after a suitable period of time has elapsed.

17 Claims, 4 Drawing Figures

FIG. 1
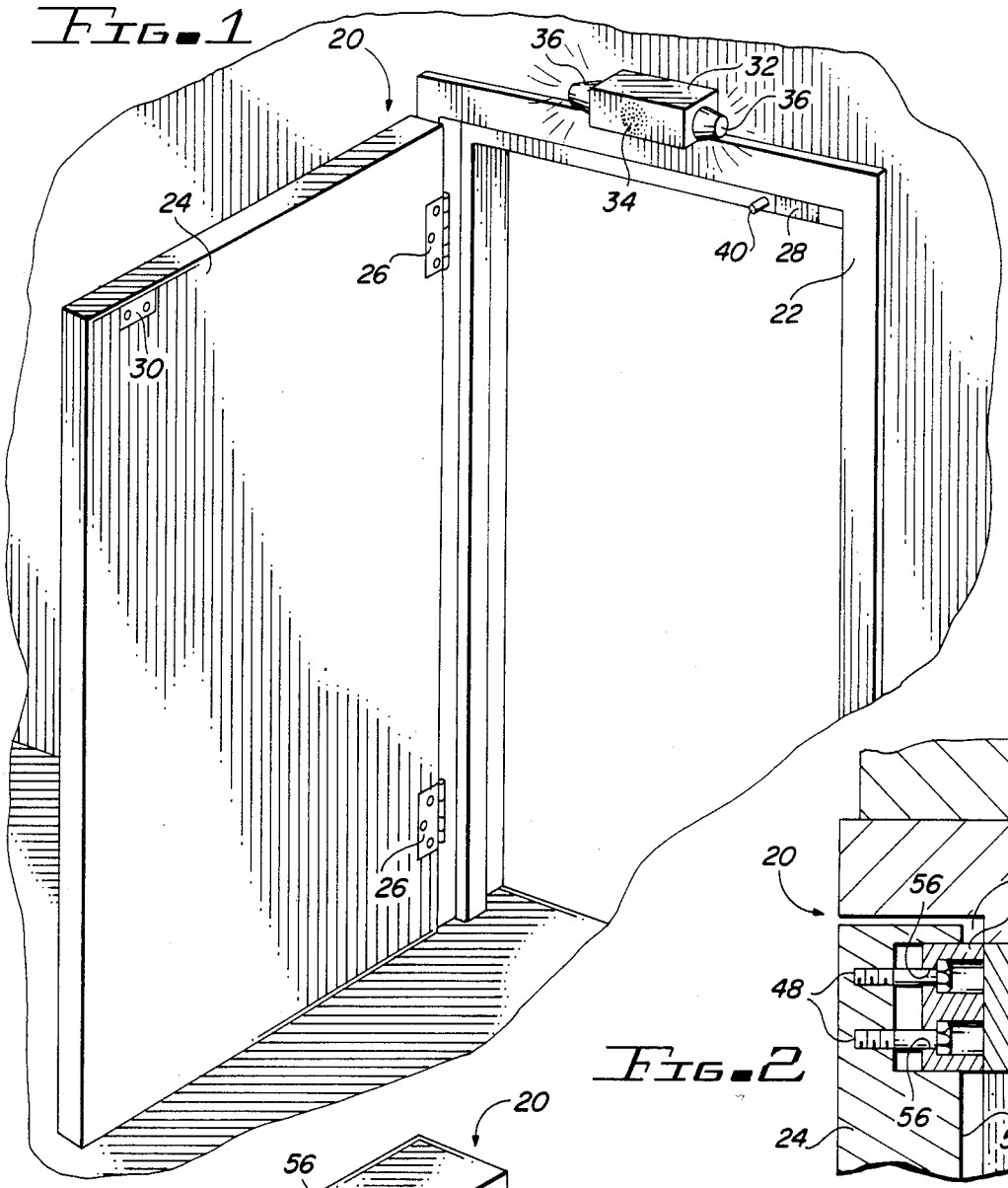
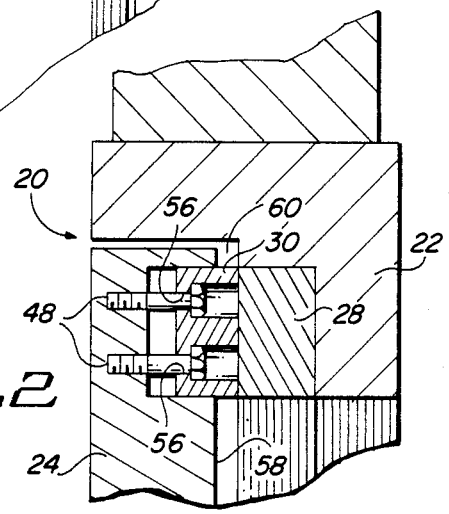
FIG. 2
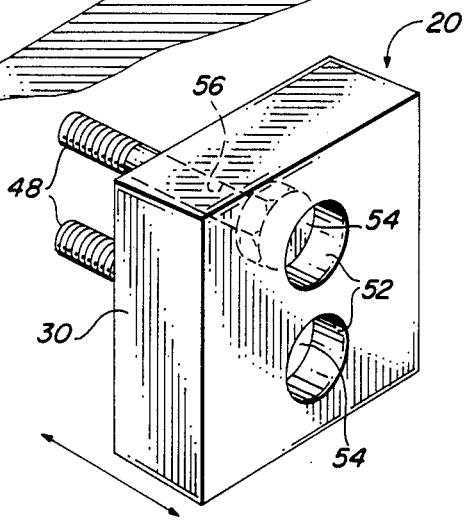
FIG. 3
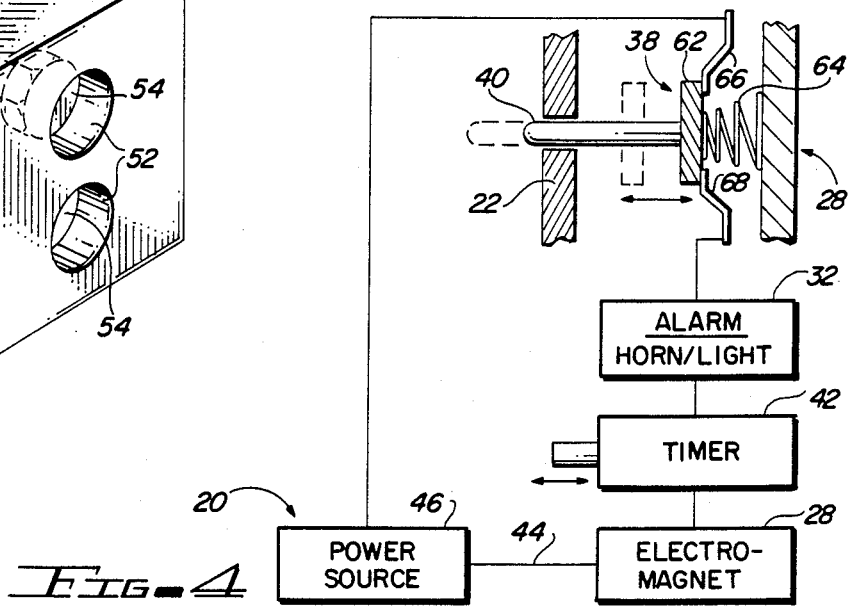
FIG. 4

EXIT DOOR SECURITY SYSTEM

BACKGROUND OF THE INVENTION

1. Field of the Invention

The present invention generally relates to security systems and, more particularly, to an exit door security system of an improved type.

2. Prior Art

Emergency exit doors must be provided by law in many buildings to permit such evacuation of building personnel in the event of a fire, earthquake or other emergency. Such exit doors generally have horizontal panic bars which permit them to be swiftly and easily opened from the inside and exited. Consequently, emergency exit doors are one means by which thieves can easily exit buildings, evading security personnel. Grocery stores, jewelry stores, clothing stores and the like suffer much loss from pilferage, with money thieves escaping through emergency exit doors. Some stores hire extra security personnel for stationing around emergency exits to reduce this risk, but such security personnel are expensive.

Other methods for solving the problem have been proposed, such as the system disclosed in U.S. Pat. No. 4,257,631 which issued on Mar. 24, 1981, to Emanuel Logan, Jr. This system is activated by a push bar which, upon depression, moves a switch carried by the door to sound an alarm and start the timer delay. Although a form of delayed opening of an emergency door is provided, the system depends upon actuation by movement of the push bar and does not sound an alarm if the door is opened without movement of the push bar (as by kicking the door to break bolt 14). Further, since the switch is carried by the door, power must be provided to the door, which is more complicated and less desirable than a fixed electrical system that perhaps is contained solely in the door jamb.

Accordingly, there is a need for an improved exit door security system which will be inexpensive, durable and effective in preventing exiting by thieves, but will not impede use of the exits in an emergency. It would also not have any requirement to deliver power to the door itself. Such system should reduce the need for security personnel, thereby effecting substantial savings for the stores, banks, etc. using such a system.

SUMMARY OF THE INVENTION

The improved exit door security system of the present invention satisfies all the foregoing needs. The system is substantially as set forth in the Abstract above. Thus, the system employs a strong electromagnet secured to the exit door frame, a magnetically attractable armature moveably secured to the exit door, and a timer, alarm and activator switch, such as a reed switch, connected in series with the electromagnet and a suitable power source. The switch abuts the door, such that when the door is closed, the switch is held in a closed circuit position against a biasing spring allowing current to flow to the electromagnet so it might strongly attract the armature and keep the door closed. But, as the door begins to open, the switch is spring biased into the open circuit position, whereby the electromagnet is deactivated to allow opening of the door, but only after the expiration of a predetermined period of time. Simultaneously the alarm is activated so that security personnel can rush to the scene and apprehend the door opener. The timer allows the closed circuit condition to continue, for example, about 10–20 seconds, or other predetermined time after which the timer interrupts the circuit, whereupon the electromagnet is inactivated and the door can be opened. Thus, the timer interposes too short a delay in opening the door to interfere with evacuation of the premises if a true emergency arises, but a long enough delay to allow security personnel to reach the door and to apprehend the door opener.

The timer and alarm are resettable automatically when the door is returned to a fully closed position.

In the preferred embodiment the lock comprises a armature freely slideable on one or more bolts to a designated position forward of the door in order to create a gap between the door and frame, whereby the armature remains strongly immoveably held to keep the door closed.

DRAWINGS

FIG. 1 is a schematic perspective view of a first preferred embodiment of the improved exit door security system of the present invention;

FIG. 2 is an enlarged, fragmentary schematic side elevation, partly broken away and partly in section, of the lock and electromagnet of the system of FIG. 1;

FIG. 3 is a schematic perspective view of the armature used in the system of FIG. 1;

FIG. 4 is a schematic circuit diagram showing the components of the system of FIG. 1, including schematic details of the activator switch of that system.

DETAILED DESCRIPTION

FIGS. 1–3

Now referring more particularly to FIG. 1 of the drawings, a first preferred embodiment of the improved exit door security system of the present invention is schematically depicted in FIG. 1. Thus, system 20 is shown which includes an exit door frame 22, an exit door 24 secured to by hinges 26, an electromagnet 28 secured to door frame 22 and an armature 30 facing electromagnet 28, and an alarm 32 comprising a horm 34 and/or blinker lights 36 secured to the top of frame 22 or in close proximity to the door 24. System 10 also includes an activator switch 38 as shown in FIG. 4, the plunger 40 of which is also shown in FIG. 1, protruding from frame 22 towards door 24. System 20 further includes a timer 42 and an electrical circuit 44 (FIG. 4) connecting electromagnet 28, timer 42, alarm 32 and activator switch 38 in series with an appropriate electrical power source 44.

Referring more particularly to FIGS. 2 and 3, lock 30 is shown to comprise a pair of spaced horizontal bolts 48 threadably mounted in door 24 and protruding forwardly thereof, and a rectangular magnetically attractable locking plate or armature 50 fitted over and slideably receiving bolts 48 in channels 52 thereof. Bolts 48 have expanded heads 54 dimensioned relative to channels 52, which have narrow diameter rear portions 56, to permit plate 50 to freely slide forward thereover, but prevent its forward removal therefrom. When fully retracted, plate 50 fits flush with surface 58 (FIG. 2) of door 24. When attracted by activated electromagnet 28, plate 50 magnetically locks thereto. As the door begins to open, armature 30 slides on bolts 48 until reaching the end of its travel (to bolt heads 54) at which point it prevents the door from further opening. Armature 30 holds to electromagnet 28 with many hundreds of pounds of anchoring force and will continue to do so unless and until electromagnet 28 is deactivated.

As shown in FIG. 4, switch 38 includes a contact plate 62 secured to the rear end of plunger 40, a spring 64 biasing plate 62 towards door 24 and contacts 66 and 68 connected to circuit 44. When door 20 is closed, it depresses plunger 40 to overcome the bias in spring 64 and allows plate 62 to bridge contacts 66 and 68, thereby connecting power source 46 to electromagnet 28, causing armature 30 to be held by electromagnet 28 and keep the door 24 closed.

When door 24 begins to be opened, plunger 40 and plate 62 is biased forward, breaking the electrical connection between contacts 66 and 68 (as shown in dotted lines in FIG. 4) to open circuit 44 allowing deactivation of electromagnet 28. Since timer 42 is placed in circuit, a delay is provided before actual deactivation of electromagnet 28, thereby preventing door 24 from fully opening until lapse of a predetermined delay period. The alarm light 32 circuit is designed to activate immediately upon opening of contacts 66, 68 and stay on until manually turned off.

It can be appreciated that the specific components and electrical circuitry are meant to be exemplary of the manner in which the invention can be implemented. Other equivalent switching mechanisms can readily be employed, as can the type of timing delay times and associated circuitry. Also, if desired, provision can be made to provide a separate circuit to completely deactivate the system, as by a manual over-ride system or in response to a fire alarm or even to a power failure. For example, instead of the spring-biased switch, one can readily use a magnetic switch, hall-effect switch, or a sensing device which is responsive to the distance between the door and the frame. Also, the system can be activated by closure of the switch or opening thereof.

It is anticipated that the system will normally be reset by closure of the door. If desired, additional reset mechanism circuitry and components can be provided so as to allow resetting by a manually operated push-bottom switch or a key operated switch. Also, the reset circuit could have a delay circuit included therein to prevent resetting for a predetermined period of time after the door is closed. The specific circuit design employed in a particular system would be dependent upon the dictates of the end use and can be readily varied to suit individual tastes.

Various other modifications, changes, alterations and additions can be made in the improved exit door security system of the present invention, its components and parameters. All such modifications, changes, alterations and additions as within the scope of the appended claims form part of the present invention.

What is claimed is:

1. An exit door security system, said system comprising, in combination:

(a) an exit door frame;

(b) an exit door connected to said frame;

(c) an electromagnet connected to said frame;

(d) a magnetically attractable armature secured to said door adapted to be attracted to and held by said electromagnet;

(e) an alarm;

(f) a timer;

(g) a power source;

(h) an electric circuit electrically interconnecting said alarm, electromagnet, timer and power source; and, (i) switch means connected in said circuit and disposed in said frame, said switch means being closed when said door is fully closed to allow activation of said electromagnet to prevent full opening of said door.

2. The system of claim 1 wherein said switch means is activated and deactivated by movement of said door.

3. The system of claim 2 wherein said switch means is deactivated when said door is partially opened.

4. The system of claim 3 wherein partial opening of said door causes said switch to be deactivated, but allowing said electromagnetic to continue to be energized because of said timer.

5. The system of claim 4 wherein said armature is moveably secured to said door.

6. The system of claim 2, wherein said armature continues to be attracted by said electromagnet when said door is partially opened even though said switch means has been opened.

7. The system of claim 6 wherein the system is automatically reset with the armature attracted by the electromagnet, when the door is closed.

8. The system of claim 1, including means to activate said alarm upon partial opening of said door and maintain operation of the alarm until the door is again fully closed.

9. The system of claim 1, including means to activate an alarm upon partial opening of said door and means to allow complete opening of said door only after the lapse of a predetermined period of time after partial opening of said door.

10. The exit door security system of claim 1 wherein said alarm includes at least one of an audible signal generating means and a visual signal generating means.

11. The exit door security system of claim 7 wherein said alarm comprises an alarm bell and a flashing light.

12. The exit door security system of claim 1 wherein said switch comprises a spring biased plunger adapted to protrude from said frame towards said door and biasable into a closed contact position against said spring bias by said door when said door is closed against said frame.

13. The exit door security system of claim 1 wherein said magnetically attractable lock comprises an armature slideably secured to said door and freely moveable between a rearward position wholly disposed on said door and a forward position extending forward of said door towards said electromagnet, whereby when the door is fully closed, the armature is attracted to said electromagnet, and as said door opening is initiated, said armature continues to be magnetically attracted by said electromagnet which it moves relative to the door, bridging the opening space between said door and said frame and holding said door locked.

14. The exit door security system of claim 13 wherein said lock includes at least one slide bolt with expanded head disposed in slide channels in said armature, the rear end of said bolt being secured to said door, said bolt head being dimensioned relative to said channel to prevent separation of said armature from said lock.

15. The exit door security system of claim 6 wherein said timer is automatically reset when said door is closed.

16. The exit door security system of claim 15 wherein said timer is electrically activated.

17. The exit door security system of claim 7 wherein said system can be overridden by an outside source and wherein removal of said power source results in deactivation of the electromagnet.

* * * * *